US007276679B2

(12) United States Patent
Cho et al.

(10) Patent No.: US 7,276,679 B2
(45) Date of Patent: Oct. 2, 2007

(54) MICROWAVE OVEN

(75) Inventors: Sung-wook Cho, Seoul (KR); Hong-man Chang, Suwon-si (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 11/195,796

(22) Filed: Aug. 3, 2005

(65) Prior Publication Data

US 2006/0027573 A1 Feb. 9, 2006

(30) Foreign Application Priority Data

Aug. 9, 2004 (KR) ..... 10-2004-0062621

(51) Int. Cl.
*H05B 6/64* (2006.01)

(52) U.S. Cl. ..... 219/757; 219/685

(58) Field of Classification Search ..... 219/680, 219/678, 679, 681, 685, 757, 756
See application file for complete search history.

(56) References Cited

U.S. PATENT DOCUMENTS

| | | | | |
|---|---|---|---|---|
| 4,049,938 | A * | 9/1977 | Ueno | 219/711 |
| 4,546,225 | A * | 10/1985 | McCammon | 219/749 |
| 4,556,772 | A * | 12/1985 | McCammon et al. | 219/757 |
| 4,596,915 | A * | 6/1986 | Simpson | 219/749 |
| 5,726,429 | A * | 3/1998 | Lim | 219/757 |
| 6,509,556 | B2 | 1/2003 | Kim | |
| 6,586,716 | B1 | 7/2003 | Lee | |
| 2004/0134908 | A1 * | 7/2004 | Jeong | 219/757 |

FOREIGN PATENT DOCUMENTS

| | | |
|---|---|---|
| EP | 1 220 573 | 7/2002 |
| JP | 60-39596 | 3/1985 |
| JP | 04-181685 | 6/1992 |
| JP | 2003-343855 | 12/2003 |
| KR | 0186155 B1 | 12/1998 |
| KR | 10-0287833 B1 | 1/2001 |
| KR | 20-0219832 Y1 | 1/2001 |
| KR | 10-2002-0036600 A | 5/2002 |
| KR | 10-0350418 B1 | 8/2002 |
| KR | 10-2004-0047077 A | 6/2004 |

OTHER PUBLICATIONS

Japanese Office Action issued May 22, 2007.

* cited by examiner

*Primary Examiner*—Daniel Robinson
(74) *Attorney, Agent, or Firm*—Sughrue Mion, PLLC

(57) ABSTRACT

A microwave oven including: a main casing forming a component compartment and a cooking compartment and formed with a component compartment through portion communicating with the component compartment; a fan assembly coupled to the main casing, and including an exhaling fan blowing air toward the component compartment through portion to cool the component compartment and a fan motor driving the exhaling fan; and a guide unit mounted to the component compartment through portion and guiding the air blown by the exhaling fan toward a heating component accommodated in the component compartment.

11 Claims, 5 Drawing Sheets

MICROWAVE OVEN

CROSS-REFERENCE TO RELATED APPLICATIONS

This application claims the benefit of Korean Patent Application No. 2004-0062621, filed on Aug. 9, 2004, in the Korean Intellectual Property Office, the disclosure of which is incorporated herein by reference.

BACKGROUND OF THE INVENTION

1. Field of the Invention

The present invention relates to a microwave oven, and more particularly, to a microwave oven having an improved structure for effectively cooling a component compartment.

2. Description of the Related Art

Generally, a microwave oven comprises a main casing forming a cooking compartment for cooking and a component compartment accommodating various components for emitting an electromagnetic wave; a door opening and closing the cooking compartment; and a control panel provided in a front of the component compartment. Further, the microwave oven generally comprises a ventilation unit to discharge air, having the smell of food, from the cooking compartment or to inhale circumferential air near the microwave oven and discharge it.

Such a conventional microwave oven, for example, a wall-mounting type microwave oven disclosed in Korean Patent First Publication No. 2004-47077, comprises a discharging fan assembly including a large-amount discharging fan and a large-amount fan motor, so that ventilation efficiency is improved. Further, the discharging fan assembly can be rotated to orient a discharging hole in various directions, so that the discharging direction can vary according to shapes of an outside duct provided in the outside of the microwave oven. Such a conventional microwave oven separately comprises a fan to cool various components accommodated in the component compartment.

However, in the conventional microwave oven, the discharging fan assembly for discharging the air from the cooking compartment is provided separately from the fan for cooling the component compartment. If the discharging fan assembly is employed for both discharging the air from the cooking compartment and cooling the component compartment, there is no need for the separate fan. Further, if the air blown toward the component compartment is guided to a high-temperature heating component among various components accommodated in the component compartment, cooling efficiency is enhanced.

SUMMARY OF THE INVENTION

An aspect of the present invention is to provide to a microwave oven having an improved structure for effectively cooling a component compartment.

Another aspect of the present invention is to provide a microwave oven comprising one fan motor to cool a component compartment and discharge air from a cooking compartment.

The foregoing and/or other aspects of the present invention are also achieved by providing a microwave oven comprising: a main casing forming a component compartment and a cooking compartment and formed with a component compartment through portion communicating with the component compartment; a fan assembly coupled to the main casing, and comprising an exhaling fan blowing air toward the component compartment through portion to cool the component compartment and a fan motor driving the exhaling fan; and a guide unit mounted to the component compartment through portion and guiding the air blown by the exhaling fan toward a heating component accommodated in the component compartment.

Consistent with an aspect of the present invention, the guide unit comprises a guide main body inclined downward to have an acute angle from the component compartment through portion toward the component compartment, and a pair of auxiliary guides protruding upward from opposite sides of the guide main body to prevent the air from flowing out of the opposite sides of the guide main body.

Consistent with an aspect of the present invention, the guide unit further comprises a stopper supporting the guide main body to keep the guide main body at a predetermined inclined angle in relation to the heating component.

Consistent with an aspect of the present invention, the guide main body and the stopper are formed by cutting and bending the main casing.

Consistent with an aspect of the present invention, the main casing further comprises a cooking compartment through portion communicating with the cooking compartment, and a discharging portion for discharging air from the cooking compartment through the cooking compartment through portion, the fan assembly further comprises a discharging fan blowing the air from the cooking compartment toward the discharging portion through the cooking compartment through portion, and the fan motor is provided between the exhaling fan and the discharging fan and drives the exhaling fan and the discharging fan.

Consistent with an aspect of the present invention, the component compartment through portion and the cooking compartment through portion are provided on top portions of the component compartment and the cooking compartment, respectively, and the microwave oven further comprises a partition wall provided between the component compartment through portion and the cooking compartment through portion to prevent the air discharged from the cooking compartment through portion from flowing toward the cooking compartment through portion.

Consistent with an aspect of the present invention, the main casing is formed with a through hole between the cooking compartment and the component compartment to send the air from the component compartment to the cooking compartment.

Consistent with an aspect of the present invention, the microwave oven further comprises an interference portion provided in the main casing to interfere with the fan assembly when at least one of the exhaling fan and the discharging fan of the fan assembly is not in a predetermined position corresponding to the component compartment through portion and the discharging portion.

Consistent with an aspect of the present invention, the interference portion protrudes from the main casing adjacent to the fan assembly.

BRIEF DESCRIPTION OF THE DRAWINGS

The above and/or other aspects and advantages of the present invention will become apparent and more readily appreciated from the following description of the exemplary embodiments, taken in conjunction with the accompany drawings of which.

DETAILED DESCRIPTION OF THE EXEMPLARY EMBODIMENT

Figure 1:
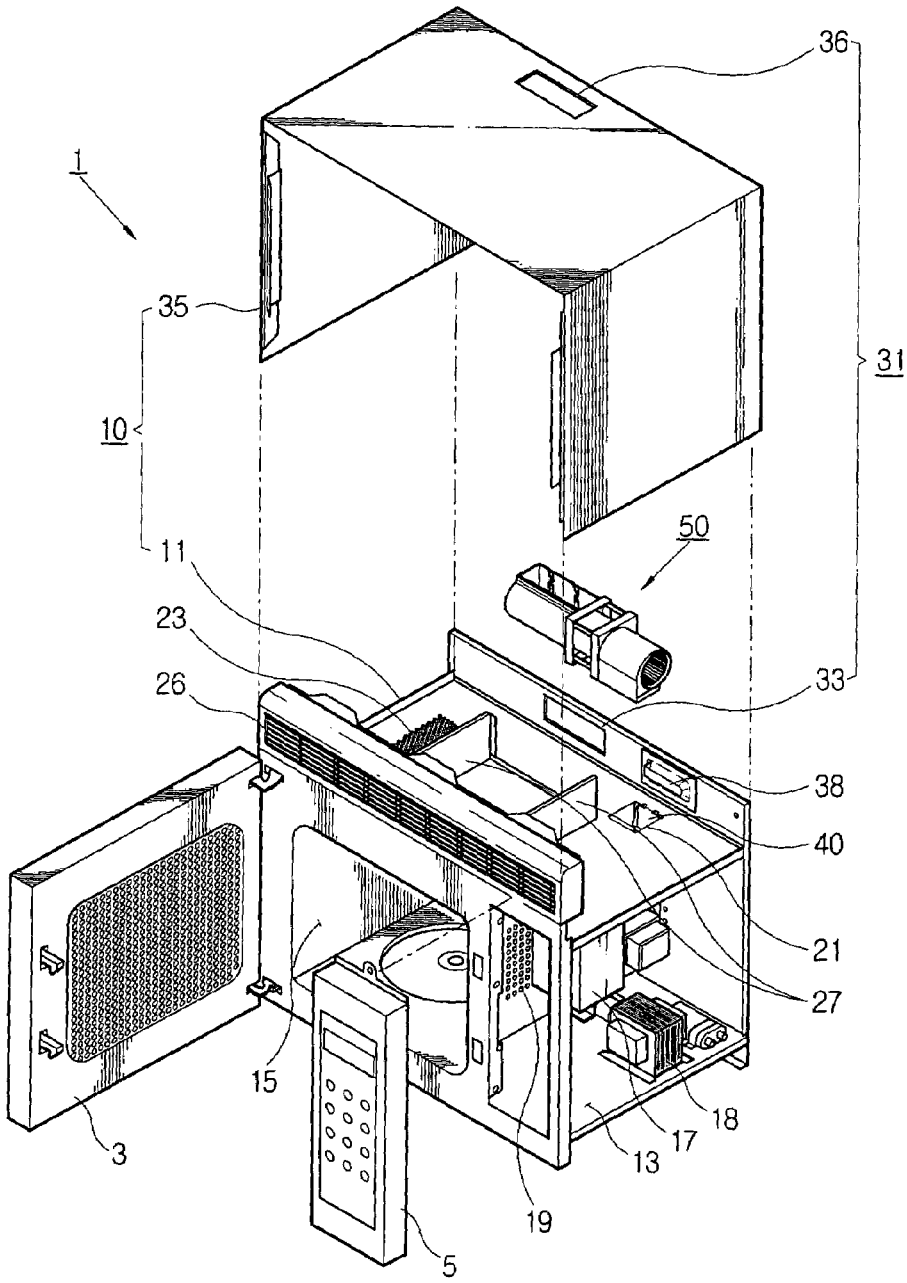
FIG. 1 is an exploded perspective view of a microwave oven consistent with an exemplary embodiment of the present invention.

Reference will now be made in detail to the exemplary embodiments of the present invention, examples of which are illustrated in the accompanying drawings, wherein like reference numerals refer to like elements throughout. The exemplary embodiments are described below in order to explain the present invention by referring to the figures.

As shown in FIGS. 1 through 5, a microwave oven 1 consistent with an exemplary embodiment of the present invention comprises a main casing 10 forming a cooking compartment 15 for cooking and a component compartment 13 accommodating various components for emitting an electromagnetic wave into the cooking compartment; a door 3 rotatably coupled to the main casing 10 and opening/closing the cooking compartment 15; a control panel 5 provided in front of the component compartment 13 and controlling various components; a fan assembly 50 provided in the main casing 10 and cooling the component compartment 13; and a guide unit 40 guiding air blown by the fan assembly 50.

The main casing 10 comprises a component compartment through portion 21 communicating with the component compartment 13. Further, the main casing 10 comprises a cooking compartment through portion 23 communicating with the cooking compartment 15, and a discharging portion 31 to discharge the air from the cooking compartment 15 through the cooking compartment through portion 23. Further, the main casing 10 comprises a main frame 11 forming the cooking compartment 15 and the component compartment 13 and formed with the component compartment through portion 21 and the cooking compartment through portion 23; and a main cover 35 covering left, right and upper sides of the main frame 11. Further, the main casing 10 comprises an interference portion 38 interfering with the fan assembly 50 when the fan assembly 50 is not in the predetermined position.

The main frame 11 is made of heat-resistant metal, but may be made of heatproof plastics. The main frame 11 provided between the cooking compartment 15 and the component compartment 13 is formed with a through hole 19 through which the air blown to the component compartment 13 is supplied to the cooking compartment 15.

The cooking compartment 15 forms a predetermined sized space to accommodate food or the like, and is formed with the cooking compartment through portion 23 at a top portion thereof through in which air with the smell of food or the like is discharged.

The component compartment 13 forms a predetermined sized space to accommodate a magnetron 17 emitting the electromagnetic wave into the cooking compartment 15, a high voltage transformer 18, etc. Here, the magnetron 17 and the high voltage transformer 18 are a heating component which generate heat of a high temperature while they operate. Therefore, the component compartment 13 is formed with the component compartment through portion 21 at a top portion thereof through which outside air is inhaled to cool the heating component.

The component compartment through portion 21 can be formed on a top portion of the main frame 11. On the component compartment through portion 21 is mounted the guide unit 40, so that the air blown by an exhaling fan 51 of the fan assembly 50 is guided toward the high temperature heating components accommodated in the component compartment 13.

The cooking compartment through portion 23 can be formed on a top portion of the main frame 11. Further, a partition wall 27 is provided between the component compartment through portion 21 and the cooking compartment through portion 23, so that the air discharged through the cooking compartment through portion 23 is prevented from being inhaled again through the cooking compartment through portion 23.

The partition wall 27 is disposed between the main frame 11 and the main cover 35. The partition wall 27 guides the air discharged from the cooking compartment though portion 23 to be discharged into the discharging portion 31 by a discharging fan 61 of the fan assembly 50. Further, the partition wall 27 extends frontward and backward between the main frame 11 and the main cover 35, and forms a pair spaced from each other. Between the pair of partition walls 27 is provided a lamp (not shown) to illuminate the cooking compartment 15. Further, a light through hole (not shown) is formed on a top portion of the main frame 11 corresponding to the lamp, so that the light emitted from the lamp is emitted to the cooking compartment 15 through the light through hole. In front of the partition wall 27 is provided a grill 26 formed with an inhaling hole to inhale circumferential air near the microwave oven 1. Thus, the air from both the cooking compartment through hole 23 and the grill 26 is discharged by the discharging fan 61 of the fan assembly 50 while being guided by the partition wall 27.

The discharging portion 31 is formed in the main casing 10 and through which the air from both the cooking compartment through hole 23 and the grill 26 is discharged. The discharging portion 31 can be connected to the outside duct extending to the outside so as to discharge the air from both the cooking compartment through hole 23 and the grill 26. Further, the discharging portion 31 may be plurally provided corresponding to the shape of the outside duct of the microwave oven 1 to be installed to a building. That is, the outside duct of a building may be provided in an upper portion or a back portion of the microwave oven 1. In this exemplary embodiment, the discharging portion 31 is provided in the top portion and the back portion of the main casing 10 in consideration of the outside duct disposed in the upper portion or the back portion of the microwave oven 1. That is, the discharging portion 31 comprises a first discharging portion 33 placed in an upper back portion of the main frame 11, and a second discharging portion 36 placed in the back portion of the main cover 35. Alternatively, the discharging portion 31 may be placed in at least one of the left, right, top and back portions of the main casing 10. Thus, a user can connect one of the plurality of discharging portions 31 to the outside duct of a building.

The main cover 35 has an inversed "U"-shape and is formed with the second discharging portion 36. Further, the main cover 35 is placed in the outside of the main frame 11, and is coupled to the main frame 11 by a screw or the like.

Figure 4:
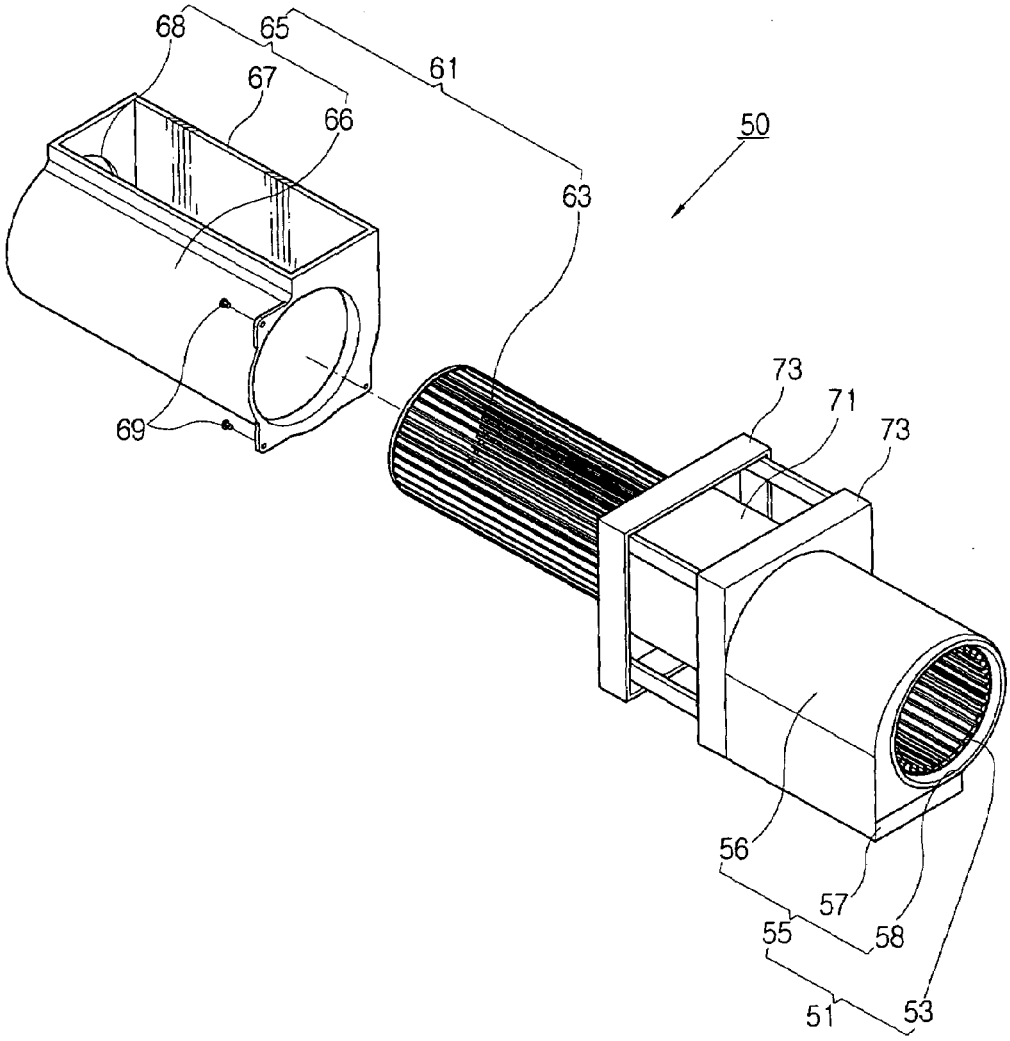
FIG. 4 is an exploded perspective view of a fan assembly in the microwave oven of FIG. 1.

The fan assembly 50, as shown in FIG. 4, comprises the exhaling fan 51 blowing the air into the component compartment through portion 21 to cool the component compartment 13, and the fan motor 71 to drive the exhaling fan 51. The fan assembly 50 comprises the discharging fan 61 opposite to the fan motor 71 across the exhaling fan 51, and discharges the air from the cooking compartment 15 toward the discharging portion 31 through the cooking compartment through hole 23. The fan assembly 50 is disposed in the upper back portion of the main casing 10 in correspondence with the component compartment through portion 21 and the discharging portion 31. Further, the fan assembly 50 is placed between the main frame 11 and the main cover 35 in a back of the partition wall 27. Here, the fan assembly 50 is interfered with the interference portion 38 when at least one of the exhaling fan 51 and the discharging fan 61 is not in the predetermined position corresponding to the component compartment through portion 21 and the discharging portion 31, so that the fan assembly 50 is correctly placed in the main casing 10.

The exhaling fan 51 comprises an exhaling blade 53 driven to rotate by the fan motor 71, and an exhaling fan cover 55 provided in the outside of the exhaling blade 53 and guiding the air blown by the exhaling blade 53 toward the component compartment through portion 21. The exhaling fan 51 is disposed at a side of the fan motor 71 in correspondence with the component compartment through portion 21.

The exhaling blade 53 is plurally provided and rotated by the fan motor 71, wherein the plurality of exhaling blades 53 are radially arranged with respect to a rotating axis.

The exhaling fan cover 55 is shaped like a cylinder, and comprises an exhaling cover main body 56 accommodating the exhaling blade 53 therein, an exhaling portion 57 formed on a cylindrical surface of the exhaling cover main body 56 and discharging the air generated by the rotation of the exhaling blade 53, and an exhaling cover through portion 58 provided in an opposite side of the exhaling fan cover 55 coupled to the fan motor 71 and through which circumferential air is inhaled. The exhaling fan cover 55 is interfered with the interference portion 38 when the exhaling portion 57 is not in the predetermined position with the component compartment through portion 21. The exhaling fan cover 55 is integrally formed with a fan motor supporter 73 (to be described later). Alternatively, the exhaling fan cover 55 may be detachably coupled to the fan motor supporter 73 by a screw or the like.

The exhaling cover main body 56 has a diameter gradually increased along a rotational direction of the exhaling blade 53 so as to gather the air generated by the rotation of the exhaling blade 53 into the exhaling portion 57. Thus, the exhaling cover main body 56 is not interfered with the interference portion 38 only when the exhaling portion 57 faces the component compartment through portion 21, but is interfered with the interference portion 38 when the exhaling portion 57 does not face the component compartment through portion 21.

The exhaling portion 57 protrudes from the exhaling cover main body 56 in correspondence with the component compartment through portion 21.

The discharging fan 61 comprises a discharging blade 63 driven to rotate by the fan motor 71, and a discharging fan cover 65 provided in the outside of the discharging blade 63 and discharging the air blown by the discharging blade 63 toward the discharging portion 31. The discharging fan 61 is placed at the other side of the fan motor 71 in correspondence with one of the first and second discharging portions 33, 36.

The discharging blade 63 is plurally provided and rotated by the fan motor 71, wherein the plurality of discharging blades 63 are radially arranged with respect to the rotating axis of the fan motor 71.

The discharging fan cover 65 is shaped like a cylinder, and comprises a discharging cover main body 66 accommodating the discharging blade 63 therein, a discharge portion 67 formed on a cylindrical surface of the discharging cover main body 66 which gathers and discharges the air generated by the rotation of the discharging blade 63, and a discharging cover through portion 68 provided in an opposite side of the discharging fan cover 65 coupled to the fan motor 71 and through which the air from both the cooking compartment through portion 23 and the grill 26 is inhaled. The discharging fan cover 65 is detachably and rotatably coupled to the fan motor 71 to make the discharge portion 67 face one of the plurality of discharging portions 31. The discharging fan cover 65 is detachably coupled to the fan motor supporter 73 by a screw 69 or the like. Further, the discharging fan cover 65 can be rotated to face one of the first and second discharging portions 33, 36 in the state that it is detached from the fan motor 71, and then coupled to the fan motor supporter 73 by the screw 69 or the like. Thus, a user can easily couple the discharging fan cover 65 with the fan motor supporter 73 by rotating the discharging fan cover 65 to make the discharge portion 67 face the discharging portion 31 corresponding to the outside duct.

The discharging cover main body 66 has a diameter gradually increased along a rotational direction of the discharging blade 63 so as to gather the air generated by the rotation of the discharging blade 63 into the discharge portion 67, like the exhaling cover main body 56. Further, the discharging portion 67 protrudes from the exhaling cover main body 56 in correspondence with the discharging portion 31.

The fan motor 71 is provided between the exhaling fan 51 and the discharging fan 61, and rotates the exhaling blade 53 and the discharging blade 63. The fan motor 71 is supported by the fan motor supporter 73 provided at opposite sides thereof, and coupled to both the exhaling fan 51 and the discharging fan 61.

The interference portion 38 is provided in the main casing 10 and interferes with the fan assembly 50 when at least one of the exhaling fan 51 and the discharging fan 61 of the fan assembly 50 is not in the predetermined position corresponding to the component compartment through portion 21 and the discharging portion 31. The interference portion 38 protrudes from the main casing 10 adjacent to the fan assembly 50. The interference portion 38 is not interfered with the exhaling fan cover 55 when the exhaling portion 57 of the exhaling fan 51 is placed facing the component compartment through portion 21, but is interfered with the exhaling fan cover 55 when the exhaling portion 57 is placed to not face the component compartment through portion 21. The interference portion 38 protrudes frontward from the main frame 11 behind the fan assembly 50. Alternatively, the interference portion 38 may be bent frontward from the main frame 11 behind the fan assembly 50. Particularly, the interference portion 38 protrudes frontward from the main frame 11 behind the exhaling fan 51 of the fan assembly 50.

Figure 2:
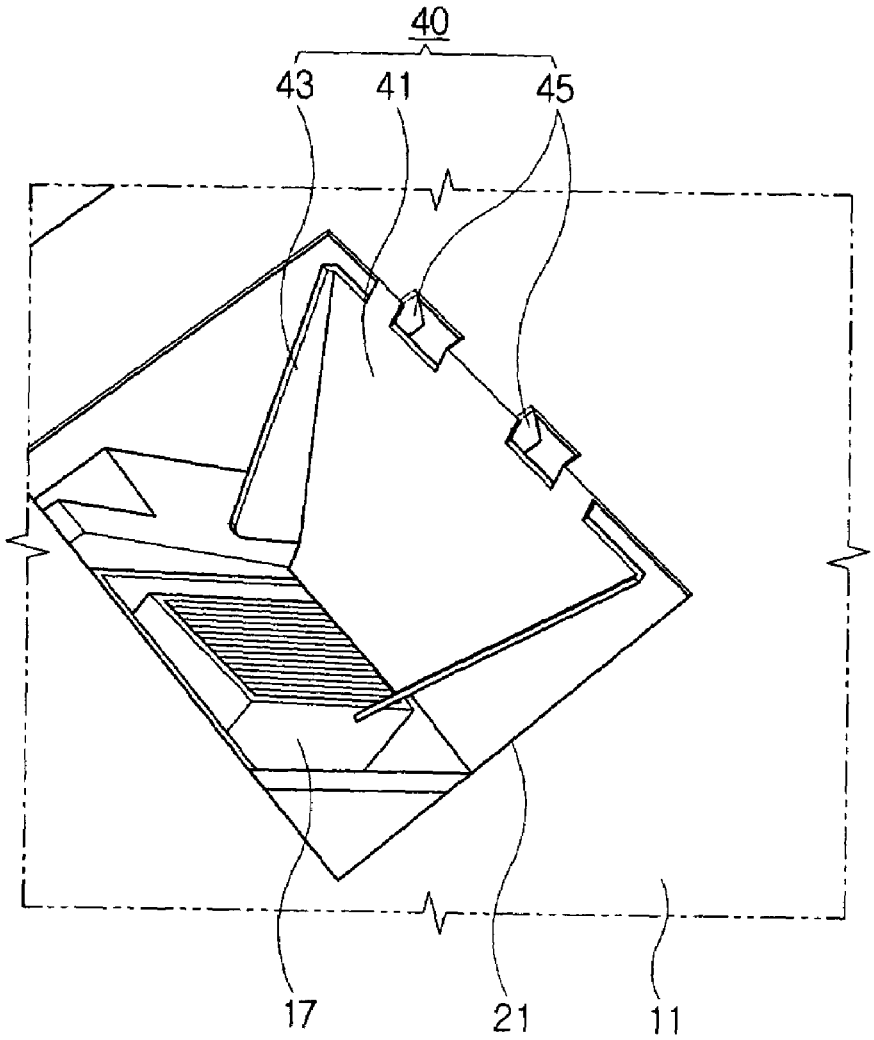
FIG. 2 an enlarged perspective view of a component compartment through portion of the microwave oven consistent with an exemplary embodiment of the present invention.
Figure 3:
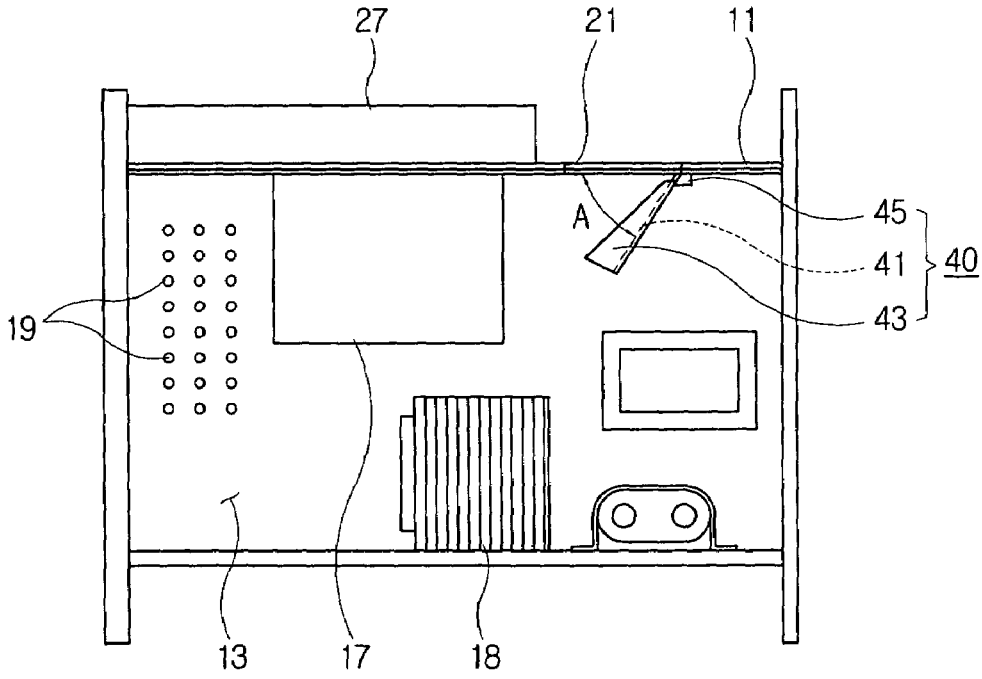
FIG. 3 is a side view of a guide unit in the microwave oven of FIG. 1.

The guide unit 40, as disclosed in FIG. 2, comprises a guide main body 41 inclined downward at an acute angle from the component compartment through portion 21 to the component compartment 13, and a pair of auxiliary guides 43 extending upward from opposite sides of the guide main body 41 to prevent the air from flowing out of the opposite sides of the guide main body 41. The guide unit 40 further comprises a stopper 45 supporting the guide main body 41 to keep the guide main body 41 at a predetermined angle of "A" (see FIG. 3) in relation to the high temperature heating components. The guide unit 40 can be formed by cutting and bending the main frame 11 of the main casing 10 corresponding to the component compartment through portion 21.

The guide main body 41 is shaped like a plate, and guides the air blown by the exhaling fan 51 toward the high temperature heating components such as the magnetron 17 and the high voltage transformer 18. The guide main body 41 is inclined at a predetermined angle of "A" from the component compartment through portion 21 to the component compartment 13, wherein the angle of "A" includes an acute angle of 0 degrees through 90 degrees. In an exemplary embodiment, the angle of "A" includes an acute angle of 30 degrees through 60 degrees. The guide main body 41 can be formed by cutting and bending the main casing 10 corresponding to the component compartment through portion 21.

The auxiliary guide 43 is formed by bending the opposite sides of the guide main body 41 upward. The auxiliary guide 43 is bent to have a gradually increased width along the lower portion of the guide main body 41, so that the guide main body 41 has a lower width thereof narrower than an upper width. Hence, the blown air is concentratedly guided toward the high temperature heating components.

The stopper 45 is plurally provided to be contactable with a rear of the guide main body 41, and prevents the guide main body 41 from being inclined at a predetermined angle greater than "A". The stopper 45 is formed by cutting and bending the main frame 11 of the main casing 10. In this exemplary embodiment, four stoppers 45 contact the rear of the guide main body 41, thereby preventing the guide main body 41 from being inclined at an angle greater than "A" due to the blown air. Alternatively, one stopper may be provided to contact the rear of the guide main body 41, or the stopper may be fastened by a bolt or welded to the rear of the guide main body and the main casing 10 forming the component compartment through portion 21.

With this configuration, the guide unit 40 of the microwave oven consistent with an exemplary embodiment of the present invention is operated as follows.

First, the fan assembly 50 is operated, and thus the air is blown by the exhaling fan 51 toward the component compartment 13 through the component compartment through portion 21. Then, the guide unit 40 extending downward from the component compartment through portion 21 makes the air blown by the exhaling fan 51 flow toward the high temperature heating components such as the magnetron 17 and the high voltage transformer 18. At this time, the air concentratedly cools the magnetron 17 and the high voltage transformer 18, and then the air cooling the component compartment 13 is supplied to the cooking compartment 15 through the through hole 19. Further, the air in the cooking compartment 15 is discharged by the discharging fan 61 through the cooking compartment through portion 23. Also, the discharging fan 61 discharges the circumferential air from the grill 26. Thus, the guide unit 40 concentratedly cools high temperature heating components such as the magnetron 17 and the high voltage transformer 18, thereby improving the cooling efficiency.

Figure 5:
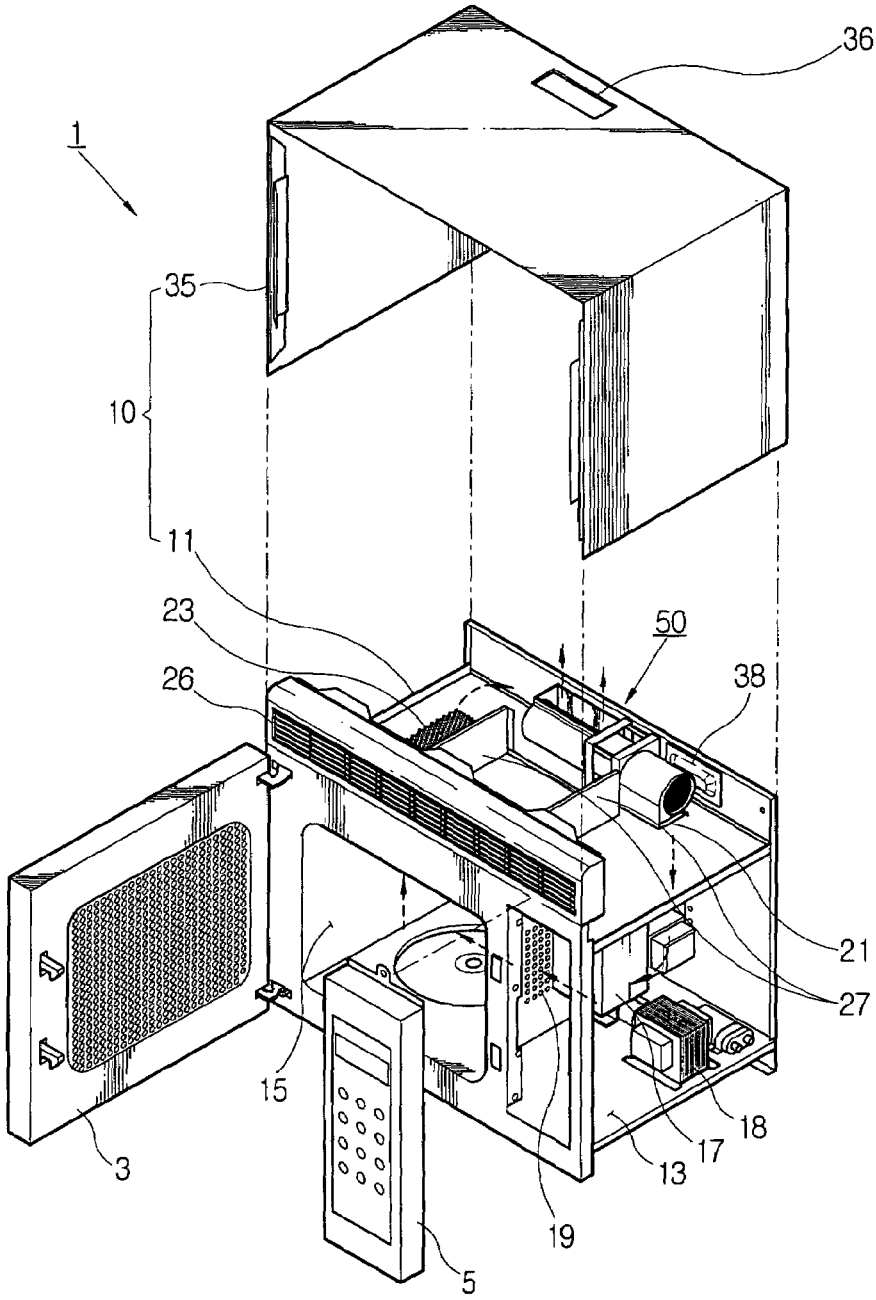
FIG. 5 is a perspective view of the microwave oven with the fan assembly of FIG. 4.

Meanwhile, in the microwave oven consistent with an exemplary embodiment of the present invention, as shown in FIG. 5, the fan assembly is coupled to the main casing as follows.

First, the discharging portion 31 is positioned to correspond with an outside duct. Further, the discharging fan cover 65 of the fan assembly 50 is rotated corresponding to the selected discharging portion 31, and then assembled. Then, the fan assembly 50 is coupled corresponding to both the component compartment through portion 21 formed on the upper portion of the main frame 11 and the selected discharging portion 31. At this time, when the fan assembly 50 is in the predetermined position corresponding to the component compartment through portion 21 and the selected discharging portion 31, the fan assembly 50 is coupled to the main casing 10 without interfering with the interference portion 38. However, when the fan assembly 50 is not in the predetermined position corresponding to the component compartment through portion 21 and the selected discharging portion 31, the fan assembly 50 is interfered with the interference portion 38 and is not coupled to the main casing 10. Here, the fan assembly 50 is coupled to the main casing by a screw or the like.

Consequently, the microwave oven consistent with an exemplary embodiment of the present invention employs the guide unit for concentratedly cooling the high temperature heating components accommodated in the component compartment, thereby improving the cooling efficiency. Further, the fan assembly comprising the exhaling fan and the discharging fan is used for both cooling the component compartment and discharging the air from the cooking compartment. Also, the circumferential air is discharged through the grill. Further, the interference portion prevents the fan assembly from not being in the predetermined position.

As described above, the exemplary embodiment of the present invention provides a microwave oven having an improved structure for effectively cooling a component compartment.

Further, the exemplary embodiment of the present invention provides a microwave oven in which a fan motor comprising an exhaling fan and a discharging fan is employed for both cooling a component compartment and discharging air in a cooking compartment.

Still further, the exemplary embodiment of the present invention provides a microwave oven in which an interference portion prevents a fan assembly from not being in the predetermined position.

Although a few exemplary embodiments of the present invention have been shown and described, it will be appreciated by those skilled in the art that changes may be made in these exemplary embodiments without departing from the principles and spirit of the invention, the scope of which is defined in the appended claims and their equivalents.

What is claimed is:

1. A microwave oven comprising:

a main casing forming a component compartment and a cooking compartment and formed with a component compartment through portion communicating with the component compartment;

a fan assembly coupled to the main casing, and comprising an exhaling fan blowing air toward the component compartment through portion to cool the component compartment through portion to cool the component compartment and a fan motor driving the exhaling fan;

a guide unit mounted to the component compartment through portion and guiding the air blown by the exhaling fan toward a heating component accommodated in the component compartment, and wherein the guide unit comprises a guide main body inclined downward to have an acute angle from the component compartment through portion toward the component compartment.

2. The microwave oven according to claim 1, wherein the guide unit comprises a stopper supporting the guide main body to keep the guide main body at a predetermined inclined angle in relation to the heating component.

3. The microwave oven according to claim 2, wherein the guide main body and the stopper are formed by cutting and bending the main casing.

4. A microwave oven comprising:

the main casing forming a component compartment and a cooking compartment and formed with a component compartment through portion communicating with the component compartment:

a fan assembly coupled to the main casing, and comprising an exhaling fan blowing air toward the component compartment through portion to cool the component compartment and a fan motor driving the exhaling fan:

a guide unit mounted to the component compartment through portion and guiding the air blown by the exhaling fan toward a heating component accommodated in the component compartment, and wherein the main casing further comprises a cooking compartment through portion communicating with the cooking compartment, and a discharging portion for discharging air from the cooking compartment through the cooking compartment through portion, the fan assembly further comprises a discharging fan blowing the air from the cooking compartment toward the discharging portion through the cooking compartment through portion, and the fan motor is provided between the exhaling fan and the discharging fan and drives the exhaling fan and the discharging fan.

5. The microwave oven according to claim 4, wherein the component compartment through portion and the cooking compartment through portion are provided on top portions of the component compartment and the cooking compartment, respectively.

6. The microwave oven according to claim 4, further comprising an interference portion provided in the main casing to interfere with the fan assembly when at least one of the exhaling fan and the discharging fan of the fan assembly is not in a predetermined position corresponding to the component compartment through portion and the discharging portion.

7. The microwave oven according to claim 6, wherein the interference portion protrudes from the main casing adjacent to the fan assembly.

8. A microwave oven comprising:

a main casing forming a component compartment and a cooking compartment and formed with a component compartment though portion communicating with the component compartment:

a fan assembly coupled to the main casing, and comprising an exhaling fan blowing air toward the component compartment through portion to cool the component compartment and a fan motor driving the exhaling fan:

a guide unit mounted to the component compartment through portion and guiding the air blown by the exhaling fan toward a heating component accommodated in the component compartment, and wherein said fan assembly further comprises a discharging fan blowing air from the cooking compartment, and wherein said discharging fan is on an opposite side of the fan assembly from the exhaling fan.

9. A microwave oven comprising:

a main casing forming a component compartment and a cooking compartment and formed with a component compartment through portion communicating With the component compartment:

a fan assembly coupled to the main casing, and comprising an exhaling fan blowing air toward the component compartment through portion to cool the component compartment and a fan motor driving the exhaling fan:

a guide unit mounted to the component compartment though portion and guiding the air blown by the exhaling fan toward a heating component accommodated in the component compartment, and wherein said fan assembly further comprises a discharging fan blowing air from the cooking compartment, and wherein the fan motor is provided between the exhaling fan and the discharging fan and drives the exhaling fan and the discharging fan.

10. A microwave oven according to claim 1, wherein the guide unit further comprises a pair of auxiliary guides protruding upward from opposite sides of the guide main body to prevent the air from flowing out of the opposite sides of the guide main body.

11. A microwave oven according to claim 5, the microwave oven further comprises a partition wall provided between the component compartment through portion and the cooking compartment through portion to prevent the air discharged from the cooking compartment through portion from flowing toward the cooking compartment through portion.

* * * * *